US011493032B2

(12) United States Patent
Nielsen et al.

(10) Patent No.: US 11,493,032 B2
(45) Date of Patent: Nov. 8, 2022

(54) ENCAPSULATED REFRIGERANT COMPRESSOR

(71) Applicant: Secop GmbH, Flensburg (DE)

(72) Inventors: Sven-Eric Nielsen, Flensburg (DE); Rolf Steinbrunn, Grossenwiehe (DE)

(73) Assignee: SECOP GMBH, Flensburg (DE)

( * ) Notice: Subject to any disclaimer, the term of this patent is extended or adjusted under 35 U.S.C. 154(b) by 443 days.

(21) Appl. No.: 16/064,186

(22) PCT Filed: Dec. 19, 2016

(86) PCT No.: PCT/EP2016/081728
§ 371 (c)(1),
(2) Date: Nov. 26, 2018

(87) PCT Pub. No.: WO2017/108682
PCT Pub. Date: Jun. 29, 2017

(65) Prior Publication Data

US 2019/0085837 A1 Mar. 21, 2019

(30) Foreign Application Priority Data

Dec. 21, 2015 (AT) ..... GM 50227/2015

(51) Int. Cl.
*F04B 39/12* (2006.01)
*F04B 39/00* (2006.01)

(52) U.S. Cl.
CPC ..... *F04B 39/123* (2013.01); *F04B 39/0061* (2013.01); *F04B 39/0072* (2013.01);
(Continued)

(58) Field of Classification Search
CPC .. F04C 2240/806; F04C 11/008; F04C 15/06; F04C 23/008; F04C 29/06–29/12;
(Continued)

(56) References Cited

U.S. PATENT DOCUMENTS 4,683,917 A * 8/1987 Bartholomew ..... F16L 11/118 138/109
4,730,695 A 3/1988 Bar
(Continued)

FOREIGN PATENT DOCUMENTS

CN 2871909 2/2007
CN 201437763 4/2010
(Continued)

OTHER PUBLICATIONS

Europe Office Action conducted in counterpart Europe Appln. No. EP 16 819 889.3 (dated Sep. 30, 2019) (w/ partial machine translation).
(Continued)

*Primary Examiner* — Bryan M Lettman
(74) *Attorney, Agent, or Firm* — Greenblum & Bernstein, P.L.C.

(57) ABSTRACT

For a refrigerant compressor, a flexible connection element that connects an end segment of a suction connection piece, which end segment protrudes into the interior of a housing, to a suction sound damper, in particular to a suction opening of the suction sound damper. The end segment itself thereby serves for fastening the flexible connection element onto the end segment and/or the inner wall of the housing.

8 Claims, 7 Drawing Sheets

(52) U.S. Cl.
CPC ..... *F05B 2240/14* (2013.01); *F05B 2260/60* (2013.01); *F05B 2260/96* (2013.01)

(58) Field of Classification Search
CPC ..... F04C 2240/804; F04C 2240/30; F04B 39/0027–39/0088; F04B 39/123; F04B 53/001–53/004; Y10T 29/49236; Y10T 29/49238; Y10T 29/49242; F05B 2240/14; F05B 2260/60; F05B 2260/96
See application file for complete search history.

(56) References Cited

U.S. PATENT DOCUMENTS

| | | | | |
|---|---|---|---|---|
| 2005/0135941 | A1 | 6/2005 | Seo | |
| 2008/0008603 | A1* | 1/2008 | Schoegler | F04B 39/123 417/312 |
| 2011/0209941 | A1* | 9/2011 | Jung | F04B 39/0061 181/229 |
| 2014/0322040 | A1* | 10/2014 | Cho | F04B 39/0061 417/312 |

FOREIGN PATENT DOCUMENTS

| | | |
|---|---|---|
| CN | 201865888 | 6/2011 |
| CN | 203730255 | 7/2014 |
| DE | 3643567 | 7/1987 |
| DE | 10244564 | 4/2004 |
| EP | 1031728 | 8/2000 |
| WO | 97/43546 | 11/1997 |
| WO | 00/07749 | 2/2000 |
| WO | 2006/067218 | 6/2006 |
| WO | 2006/109239 | 10/2006 |
| WO | 2007/015222 | 2/2007 |
| WO | 2007/083905 | 7/2007 |

OTHER PUBLICATIONS

Official Communication issued in Austria Patent Application No. GM 50227/2015, dated May 18, 2016.
China Office Action conducted in counterpart China Appln. No. 201680079824 (dated Jun. 25, 2019) (w/ English Translation).

* cited by examiner

ENCAPSULATED REFRIGERANT COMPRESSOR

FIELD OF THE INVENTION

An encapsulated refrigerant compressor comprising a drive unit, a cylinder block which comprises at least one cylinder and a piston that is in operative connection with the drive unit and moves back and forth within the cylinder, a cylinder cover which is connected to the cylinder block via a valve plate, wherein the valve plate comprises at least one inlet valve and at least one outlet valve in order to enable a flow, caused by the piston movement, of refrigerant into the cylinder via the inlet valve and out of the cylinder via the outlet valve, a housing which encloses at least the drive unit, the cylinder block, and the cylinder cover, an end segment of a suction connection piece for the refrigerant, which end segment protrudes into the housing and has an outlet opening via which refrigerant can flow into the interior of the housing, a suction sound damper, which suction sound damper comprises at least one suction opening facing the end segment, and a flexible connection element which produces a flow connection between the end segment and the suction opening of the suction sound damper in order to enable a transfer flow of refrigerant from the suction connection piece into the at least one suction sound damper via the end segment, wherein means for attaching the flexible connection element to the end segment and/or an inner wall of the housing are provided, wherein the end segment itself is the means for attaching the flexible connection element to the end segment and/or an inner wall of the housing, wherein the end segment is embodied in the form of a pipe and comprises an enlargement segment, the outer jacket surface of which widens, preferably continuously, in a direction pointing towards the suction sound damper, and wherein the flexible connection element comprises a first attachment segment which is arranged between the end of the enlargement segment that faces the suction sound damper and the inner wall such that it surrounds the end segment.

PRIOR ART

Refrigerant compressors comprise both components that are firmly connected to the compressor housing (i.e., suction connection piece, pressure connection piece, evacuation connection piece) and also components which are positioned in a springable manner on the inner wall/the base of the housing and are set in motion/vibration by the piston movement in the operating state of the compressor (for example, drive unit, cylinder block, suction sound damper).

A fundamental problem in the planning and development of compressors of this type is therefore the creation of a flow connection between components which, because of the movement/vibration described above, perform a relative motion to one another, in particular between the end region of a suction connection piece which penetrates the housing, and the suction sound damper.

In this context, connection elements are known which connect the end segment of the suction connection piece, which end segment protrudes into the interior of the housing, to the suction sound damper of the compressor in order to enable a transfer flow of the refrigerant circulating in the cooling circuit from the suction connection piece into the suction sound damper via the connection element.

This flow connection can, in principle, be embodied in a fully leak-tight manner; however, it is also already very advantageous if a large portion of the refrigerant entering into the interior of the housing via the suction connection piece is conducted directly into the suction sound damper and subsequently suctioned into the cylinder, and is not first distributed in the interior of the housing and heated due to contact with components having a high operating temperature before it is suctioned into the cylinder.

Flexible connection elements which can be made of elastomer, for example, have proven particularly useful for this purpose. By means of flexible connection elements of this type, it is possible to produce a not necessarily completely leak-tight flow connection between the end segment of the suction connection piece and the suction sound damper, even with significant relative motion of these two components to one another.

For compressors according to the prior art, however, separate fastening means are always necessary to fasten these flexible connection elements on the end segment of the suction connection piece, which means fasten the connection element onto the end region. Separate fastening means of this type have the disadvantage that over time, for example, as a result of fatigue phenomena in the material of the fastening means or as a result of the vibrations occurring during operation, a slipping-down of the connection element from the end segment and/or the suction sound damper can occur, and thus also a detaching of the flexible connection element from the suction connection piece.

SUMMARY OF THE INVENTION

In light of the aforementioned disadvantages, an object of the invention is to minimize, or completely prevent, the risk of a slipping-down of the connection element from the suction connection piece by means of the type of attachment of the connection element.

A further embodiment of the present invention is to fix the connection element in its position in a particularly simple and cost-effective manner.

Additionally, an embodiment of the present invention is to provide a method of assembly for a connection element according to the invention, which method can be carried out in a particularly simple and fully automated manner.

With an encapsulated refrigerant compressor according to the invention, comprising a drive unit, a cylinder block which comprises at least one cylinder and a piston that is in operative connection with the drive unit and moves back and forth within the cylinder, a cylinder cover which is connected to the cylinder block via a valve plate, wherein the valve plate comprises at least one inlet valve and at least one outlet valve in order to enable a flow, caused by the piston movement, of refrigerant into the cylinder via the inlet valve and out of the cylinder via the outlet valve, a housing which encloses at least the drive unit, the cylinder block, and the cylinder cover, an end segment of a suction connection piece for the refrigerant, which end segment protrudes into the housing and has an outlet opening via which refrigerant can flow into the interior of the housing, a suction sound damper, which suction sound damper comprises at least one suction opening facing the end segment, and a flexible connection element which produces a flow connection between the end segment and the suction opening of the suction sound damper in order to enable a transfer flow of refrigerant from the suction connection piece into the at least one suction sound damper via the end segment, wherein means for attaching the flexible connection element to the end segment and/or an inner wall of the housing are provided, wherein the end segment itself is the means for attaching the flexible connection element to the end segment and/or an inner wall of the housing, wherein the end segment is embodied in the form of a pipe and comprises an enlargement segment, the outer jacket surface of which widens, preferably continuously, in a direction pointing towards the suction sound damper, and wherein the flexible connection element comprises a first attachment segment which is arranged between the end of the enlargement segment that faces the suction sound damper and the inner wall such that it surrounds the end segment, an object of the invention is attained in that the first attachment segment bears with the one end thereof against the inner wall and bears with the other end thereof against the preferably continuously expanding enlargement segment.

Thus, the attachment of the flexible connection element to the end segment and/or the inner wall of the housing occurs in a particularly simple and cost-effective manner.

The term "attachment" is to be understood in this context such that, while a slipping-down of the connection element from the end segment is prevented, movements by the flexible connection element, in particular by the first attachment segment, along the end segment are in principle possible.

Separate fastening means provided for the attachment are not required according to the invention, which on the one hand helps to reduce costs and, on the other hand, helps to simplify considerably the production process for the compressor.

Instead, the end segment itself of the suction connection piece penetrating the housing or the inner wall of the housing serves as a means of attachment for the flexible connection element. This end segment can thereby on the one hand already be provided before the mounting of the suction connection piece on the housing with a special shape that takes this function into account. On the other hand, a suction connection piece that does not yet comprise a deformation of this type can first be mounted in an uncomplicated manner and only then, after the flexible connection element is pulled onto the end segment, deformed accordingly for the attachment of the flexible connection element to the suction connection piece.

The latter variant is suitable particularly in the case of a one-piece embodiment of the suction connection piece with the end segment thereof, since the suction connection piece can be inserted into an opening of the housing from any desired side and then connected, preferably welded, to the housing. The deformation of the end segment can subsequently take place in a simple manner once the flexible connection element—the flexibility of which is in this case initially based on positions variable relative to one another of two end regions of the flexible connection element, which end regions oppose one another in an axial direction of the connection element—has been slid onto the end segment.

For variants in which the suction connection piece and the end segment are not embodied in one piece, it can be beneficial to first fasten the end segment onto the housing and only then to connect the section of the suction connection piece that runs outside the housing to the end segment or the housing via the opening of the housing. Thus, end segments shaped in any desired manner can be conveniently fastened onto the housing without the size and shape of the opening of the housing thereby having a limiting effect. The attachment of the flexible connection element to the deformed end segment can, in cases of this type, take place in that the flexible connection element with a likewise flexibly embodied end region, the circumference of which can be varied as a result of the flexibility of said end region, is pulled past the deformation onto the end segment.

The quality of the flexible connection element must thereby only ensure the possibility of the transfer flow of refrigerant; a completely leak-tight flow connection does not need to be provided, however. In individual cases, it can even be desired that the flexible connection element comprises means, for example, valves, for equalizing the pressure with the housing interior.

In principle, there exists a plurality of possible shapes of the end segment of the suction connection piece, which shapes render the end segment a suitable means for attaching the flexible connection element to the end segment and/or an inner wall of the housing. One particularly simple shape of this type is, for example, a widening of a pipe forming the end segment, which widening runs in the direction of the suction sound damper.

Therefore, according to the invention, it is provided that the end segment is embodied in the form of a pipe and comprises an enlargement segment, the outer jacket surface of which widens, preferably continuously, in a direction pointing towards the suction sound damper.

By means of an enlargement segment of this type, a slipping-down of the flexible connection element from the end segment is prevented.

However, it is thereby not absolutely necessary that the end segment comprise a circular profile. The simple shape of the end segment, which shape corresponds to this embodiment, can, in the case of end segments having any desired profile, be achieved in that the circumference of the cross-sectional surface of the end segment increases as the distance to the housing inner wall increases.

For example, a widening of the end segment, which widening extends continuously from the housing inner wall, can be provided.

In another preferred embodiment of the refrigerant compressor according to the invention, it is provided that the enlargement segment connects directly to the inner wall.

Since the enlargement segment of this embodiment directly connects to the inner wall, a particularly secure fit of the connection element on the end segment of the suction connection piece is ensured.

However, in order to accommodate different designs of the flexible connection piece, it can be advantageous that the enlargement section does not connect directly to the inner wall, but rather only begins at some distance from the inner wall.

Another preferred embodiment of the refrigerant compressor according to the invention therefore envisages that a spacer segment runs between the inner wall and the enlargement segment.

To enable a particularly simple and resistance-free transfer flow of the refrigerant from the end segment of the suction connection piece into the flexible connection element, it is provided in another preferred embodiment of the refrigerant compressor according to the invention that the enlargement segment comprises the outlet opening.

In another preferred embodiment of the refrigerant compressor according to the invention, the preferably continuous widening of the outer jacket surface of the enlargement segment is produced in a particularly simple manner by means of a bending-open or crimping.

A widening of this type can thus be produced either even before the mounting of the end segment on the housing by means of known manual or automatic methods or alternatively, for example, can be subsequently created by means of a mandrel driven into the outlet opening of the end segment that has already been mounted on the housing.

According to the invention, it is provided that the flexible connection element comprises a first attachment segment which is arranged between the end of the enlargement section which faces the suction sound damper and the inner wall such that it surrounds the end segment.

A slipping-down of the flexible connection element from the end segment of the suction connection piece is thus not possible, since the first attachment segment of the flexible connection element cannot surmount the enlargement segment of the end segment without any additional effort.

To minimize, to the greatest possible extent, potential movements along the spacer segment in an axial direction of the spacer segment by the first attachment segment arranged between the enlargement segment and the inner wall, it is provided according to the invention that the first attachment segment bears with the one end thereof against the inner wall and bears with the other end thereof against the preferably continuously expanding enlargement segment.

In a further embodiment of the refrigerant compressor according to the invention, it is provided that the first attachment segment is clamped by the inner wall and the enlargement section.

This is a particularly preferred embodiment of the refrigerant compressor according to the invention, since the flexible connection element is fixed to the inner wall of the housing by means of the first attachment segment thereof clamped between the inner wall and the enlargement segment, which leads to a significantly increased stability of the attachment of the flexible connection element.

To increase the stability of the attachment even further, and to be able to use a flexible connection element in combination with end segments having different diameters and/or shapes, an additional retaining element which surrounds the enlargement segment and/or spacer segment is provided in another preferred embodiment of the refrigerant compressor according to the invention.

By positioning a retaining element of this type intermediately between the first attachment segment and the enlargement segment, it is possible to use a specific design of the flexible connection element for different end segments—for example, in different compressor series. Even in cases where an opening in the first attachment segment, along which opening the first attachment segment surrounds the end segment of the suction connection piece, has a significantly larger diameter than the spacer segment of the end segment, a suitable retaining element can still result in a blockage of the attachment segment by the enlargement segment.

In addition, the stability of the flexible connection element attached to the inner wall of the housing by means of the clamped first attachment segment is increased by the intermediate positioning of a retaining element according to the invention embodied, for example, as an annulus, since the clamping effect exerted on the flexible connection element by the first enlargement segment is evenly transferred onto an entire section of the first attachment segment, which section connects to the retaining element, provided that the first attachment segment is clamped between the retaining element and the inner wall.

Therefore, in a further preferred embodiment of the refrigerant compressor according to the invention, it is provided that the first attachment segment is clamped between the inner wall and the retaining element.

In order to maximize the stability of the attachment of the flexible connection element to the inner wall of the housing, it is provided in another particularly preferred embodiment of the refrigerant compressor according to the invention that the additional retaining element is manufactured from plastic or steel.

In another preferred embodiment of the refrigerant compressor according to the invention, it is provided that the flexible connection element is embodied as a bellows.

Through the use of a standard component of this type as a flexible connection element, the production costs for the compressor according to the invention are further reduced. Additionally, as a result of the flexibility of the bellows, a preservation of the flow connection is still possible even in the case of strong relative movements between the suction sound damper and the suction connection piece end segment. Preferably, the bellows is thereby embodied such that, even in the event of a maximum compression of the bellows, it still comprises an axial expansion which prevents the contact between the suction sound damper and the end segment.

In another preferred embodiment of the refrigerant compressor according to the invention, it is provided that the flexible connection element comprises a second attachment segment which is fastened to the suction sound damper in the region of the suction opening.

In this manner, an optimal flow connection between the outlet opening of the end segment and the suction opening of the suction sound damper can be produced.

To enable a mounting of the flexible connection element that is particularly simple and can be fully automated, according to the invention a method is proposed for attaching a flexible connection element to an end segment of a suction connection piece, which end segment is spaced inwards from the wall of a housing of an encapsulated refrigerant compressor and which comprises an outlet opening for the refrigerant, which method comprises the following steps:

- a pulling of a first attachment segment of the flexible connection element over the end segment and preferably a sliding-forward of the first attachment segment in the direction of the housing,
- an insertion of a mandrel into the outlet opening, which mandrel has an increasing diameter in an axial direction,
- a driving of the mandrel, preferably by means of a hammer, in the direction of the housing for a preferably continuous widening of the outer jacket surface of the end segment.

The sliding-forward of the first attachment segment in the direction of the housing is thereby a method step which can be necessary if the end segment comprises a spacer segment.

BRIEF DESCRIPTION OF THE DRAWINGS

The invention will now be explained in greater detail with the aid of exemplary embodiments. The drawings are by way of example and are intended to demonstrate, but in no way restrict or exclusively describe, the inventive concept. In this matter.

DETAILED DESCRIPTION

Figure 1:
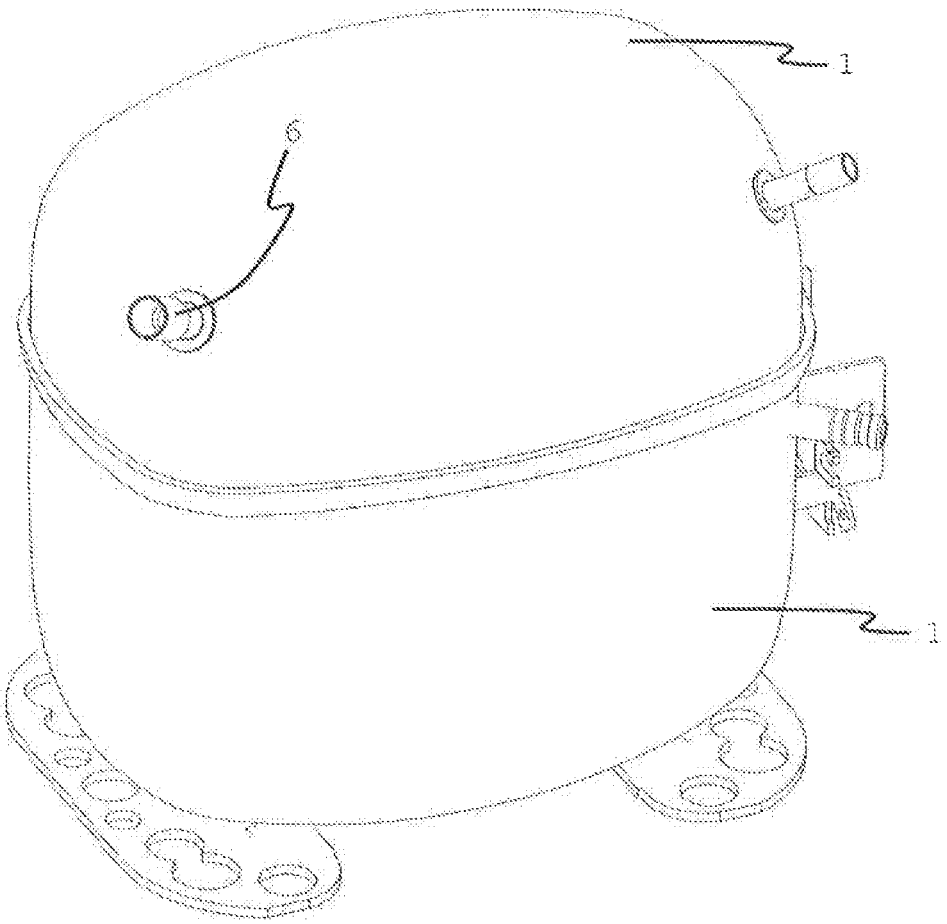
FIG. 1 shows a refrigerant compressor in an external view

FIG. 1 shows a refrigerant compressor according to the invention in an external view, wherein the refrigerant compressor comprises an upper section, specifically a cover, of a housing 1, which section comprises a suction connection piece 6. In addition to the suction connection piece 6 welded onto the cover in the specific exemplary embodiment, via which connection piece refrigerant is suctioned into a cylinder of a cylinder block 2 (see FIG. 2) in order to be compressed in said block, the noted housing section also comprises a pressure line, which is not provided with a reference numeral and by means of which compressed refrigerant can be transported in the direction of a condenser arranged in the cooling circuit. Furthermore, an evacuation connection piece can also be seen which is used to create a vacuum within the compressor or the entire cooling circuit, the operational principle of which is not discussed in further detail at this juncture.

Figure 2:
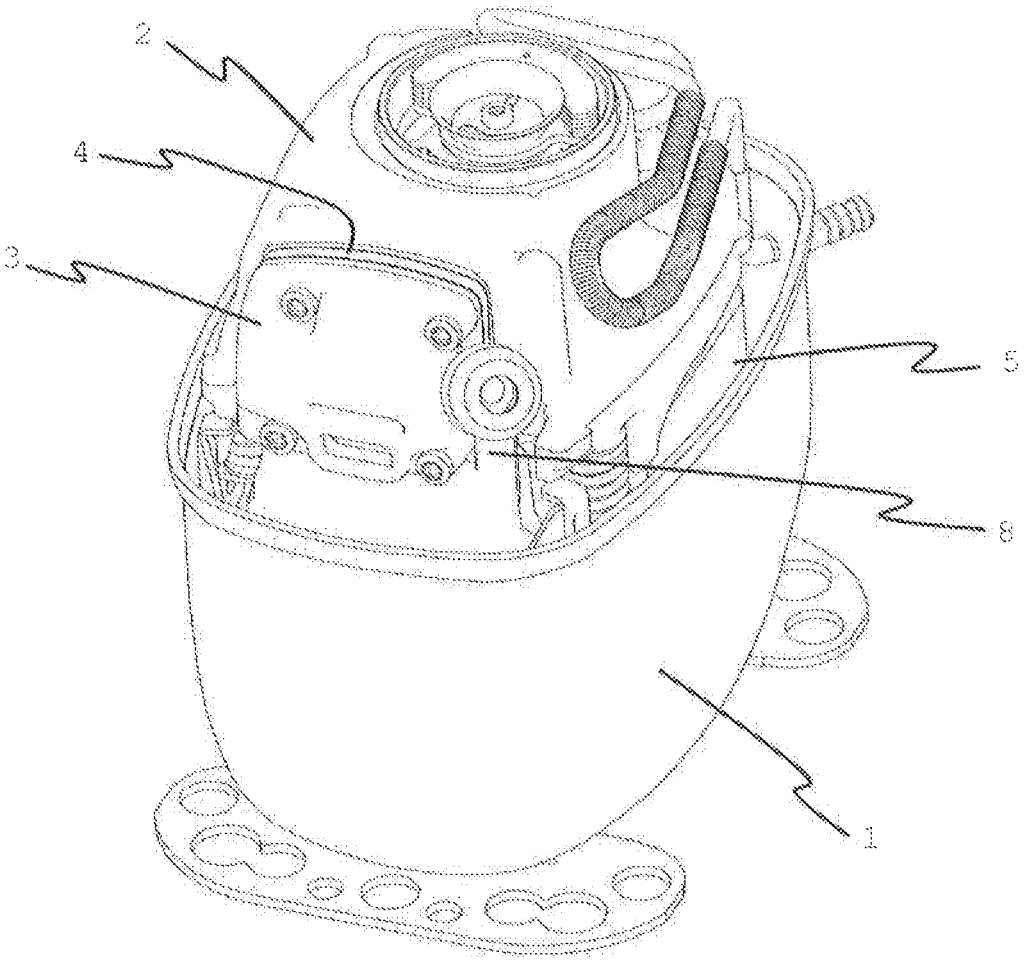
FIG. 2 shows the refrigerant compressor from FIG. 1, wherein a section of the compressor housing comprising a suction connection piece is not illustrated

FIG. 2 shows a refrigerant compressor according to the invention, wherein the housing section comprising the suction connection piece 6 is not illustrated.

Accordingly, a drive unit 5, the cylinder block 2 connecting to the drive unit 5 in a vertical direction, a cylinder cover 3 that is separated from the cylinder block 2 by means of a valve plate 4, and a suction sound damper 8 can be seen.

Figure 3:
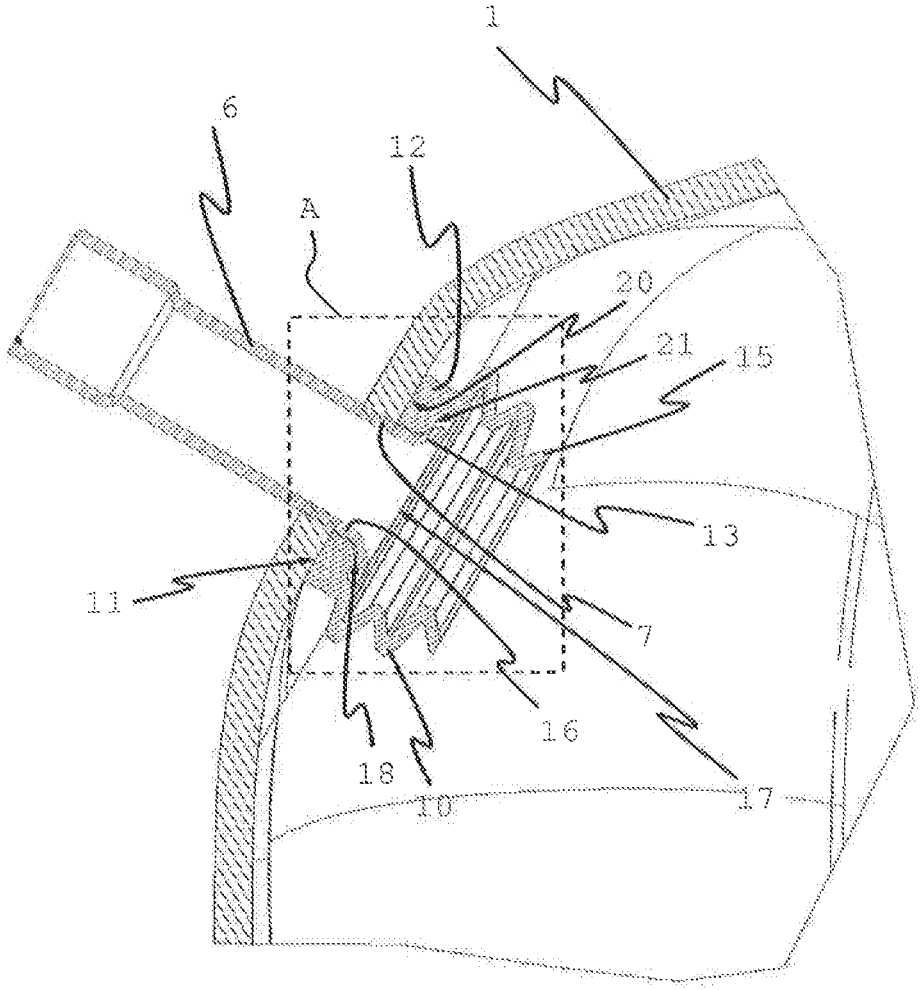
FIG. 3 shows a flexible connection element which is attached according to the invention to the end segment of a suction connection piece

FIG. 3 shows a detailed view of a flexible connection element 10 that is attached according to the invention to the end segment 7 of a suction connection piece 6 and, in the specific exemplary embodiment, is embodied as a bellows.

An end segment 7 of the suction connection piece 6 protrudes into an inner region of the housing 1 from the outside. The end segment 7 is thereby defined as that segment of the suction connection piece 6 which lies in the inner region. The end segment 7 comprises an enlargement segment 13, the outer jacket surface 18 of which widens continuously in a direction facing axially away from the suction connection piece 6. Furthermore, the end segment 7 is also composed of a spacer segment 16 which runs between an inner wall 11 of the housing 1 and the enlargement segment 13.

The flexible connection element 10 is attached to the end segment 7 in such a way that it, together with a first attachment segment 12, surrounds, at least in individual sections, both the spacer segment 16 and also the enlargement segment 13 on the shared outer jacket surface 18. A first end 20 of the first attachment segment 12 thereby directly abuts on the inner wall 11 of the housing 1, whereas a second end 21 of the first attachment segment 12 directly abuts on the outer jacket surface 18 of the enlargement segment 13.

The end segment 7 itself, in this case specifically the enlargement segment 13, serves in this exemplary embodiment as a means for attaching the flexible connection element 10 to the end segment 7 and to the housing 1. Because of the shape of the enlargement segment 13, the end segment 7 secures the first attachment segment 12 of the flexible connection element 10 against the inner wall 11 in the specific exemplary embodiment. The first attachment segment 12 is thus clamped in between the enlargement segment 13 and the inner wall 11.

Figure 3A:
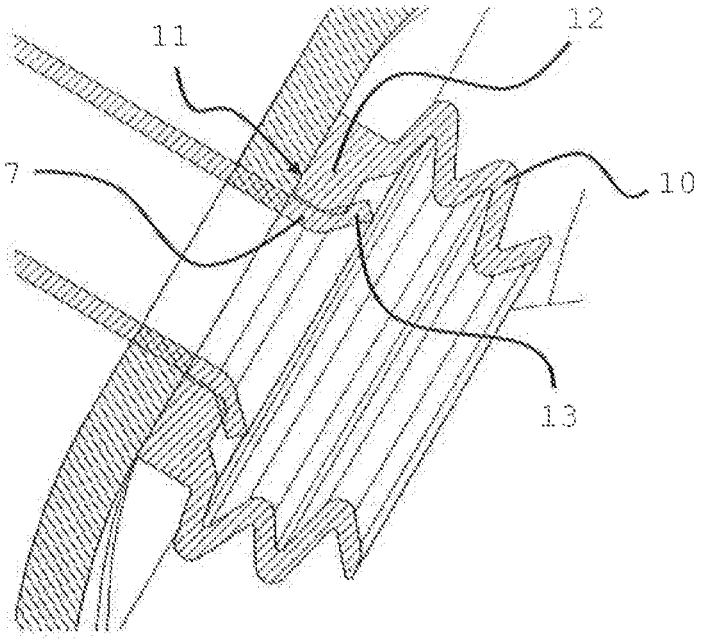
FIG. 3*a* shows the detailed illustration A from FIG. 3

This situation is illustrated by the detailed view in FIG. 3*a*. As a result of its specific shape, the enlargement segment 13 of the end segment 7 ensures that the flexible connection element 10 is fixed in position on the end segment 7, namely by means of a clamping of the first attachment segment 12 between the enlargement segment 13 itself and the inner wall 11 of the housing 1.

Figure 3B:
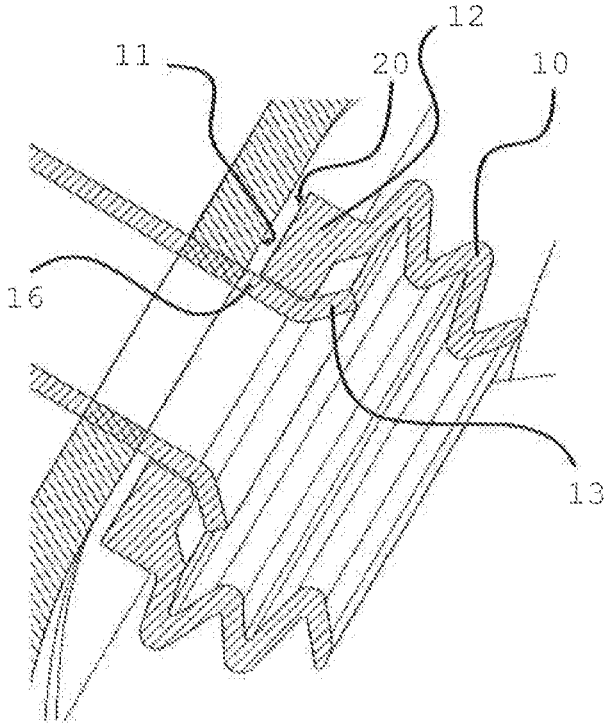
FIG. 3*b* shows a detailed view corresponding to FIG. 3*a* of an alternative embodiment with a longer spacer segment

FIG. 3*b* shows in this context an alternative embodiment of the refrigerant compressor according to the invention, in which the flexible connection element 10 is attached to the end segment 7 of the suction connection piece 6 by means of the enlargement segment 13 and is thus secured against a slipping-down from said end segment, but is not fixed in position—as shown, for example, in FIG. 3*a*—on the inner wall 11 by means of a clamping. Instead, the illustrated type of attachment of the flexible connection element 10 permits a spacing of the first end 20 of the first attachment segment 12 of the flexible connection element 10 from the inner wall 11. The flexible connection element 10 is thus attached to the end segment 7 such that it can be displaced in an axial direction of the suction connecting piece 6. However, the enlargement segment 13 of the end segment 7 still prevents a slipping-down of the flexible connection element 10 from the end segment 7. Especially in the case of alternative embodiments of the refrigerant compressor with longer spacer segments 16, an attachment of this type can be advantageous.

Figure 4:
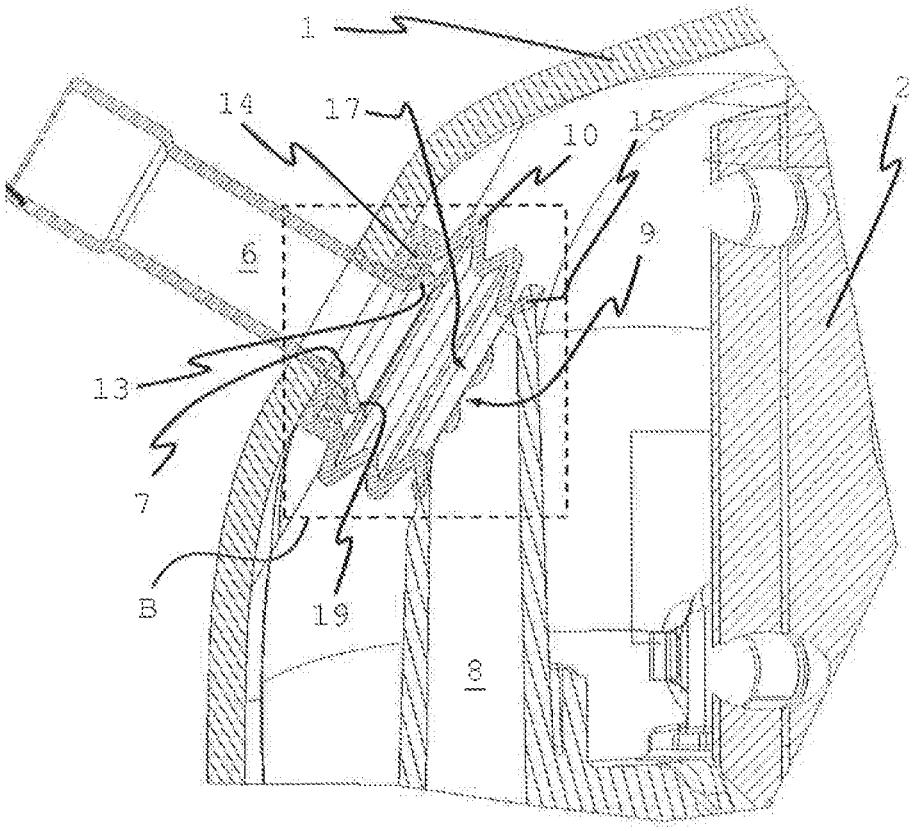
FIG. 4 shows a flexible connection element which is attached to the end segment of a suction connection piece with an intermediate positioning of a retaining element
Figure 4A:
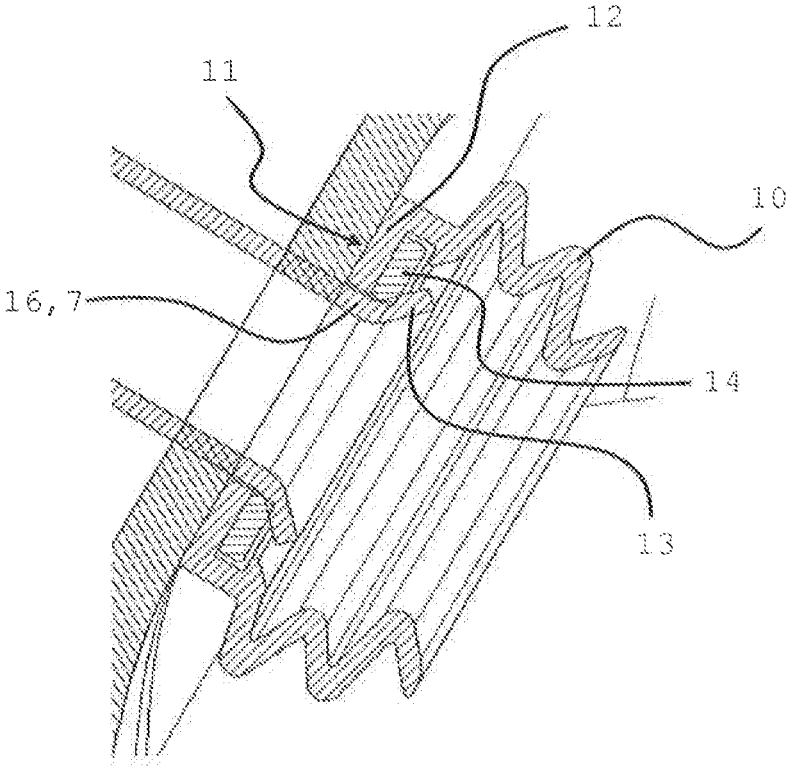
FIG. 4*a* shows the detailed illustration B from FIG. 4 (without a suction sound damper)

FIG. 4 and the detailed view FIG. 4*a* show further specific exemplary embodiments of the flexible connection element 10 which is attached to the end segment 7 and the housing 1 with an intermediate position of a retaining element 14, which is embodied as an annulus in the specific exemplary embodiment. The attachment of the flexible connection element 10, which attachment is not necessarily leak-tight, with the second attachment segment 15 thereof to the suction sound damper 8 can thereby also be seen.

Refrigerant that flows through the suction connection piece 6 in the direction of the cylinder 2 (see also FIGS. 2 and 4) can first flow into the connection element 10 via the outlet opening 17 of the end segment 7 and then from the connection element 10 into the suction sound damper 8 via a suction opening 9 of the suction sound damper 8.

The retaining element 14 can, in preferred alternative embodiments of the flexible connection element 10 according to the invention, be provided in order to allow flexible connection elements that would slide down from the end segment 7 because of an excessively large diameter of the opening of the first attachment segment 12 to nevertheless be attached to the end segment and/or to the inner wall. In such cases, the retaining element 14 has an inner radius that is based on the outer pipe diameter of the end segment 7, in particular of the spacer segment 16, and an outer radius that is greater than the radius of the opening of the first attachment segment 12. In this manner, a slipping-down of the retaining element 14 from the end segment 7 is first prevented by the enlargement segment 13 and a slipping-down of the flexible connection element 10 is consequently also prevented by the blocked retaining element 14.

On the other hand, the clamping of the first attachment segment 12 exerted by the enlargement segment 13 is evenly distributed onto a larger region of the first attachment segment 12, namely essentially onto the entire first end 20 thereof, and the fastening of the flexible connection element 10 on the housing 1 is thus increased overall.

Figure 5A:
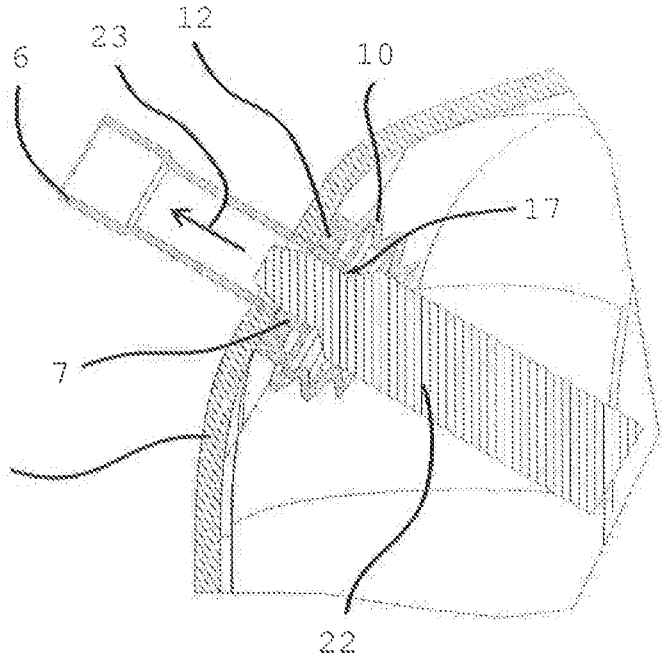
FIG. 5*a* shows a first method step for producing an end segment of a suction connection piece according to the invention
Figure 5B:
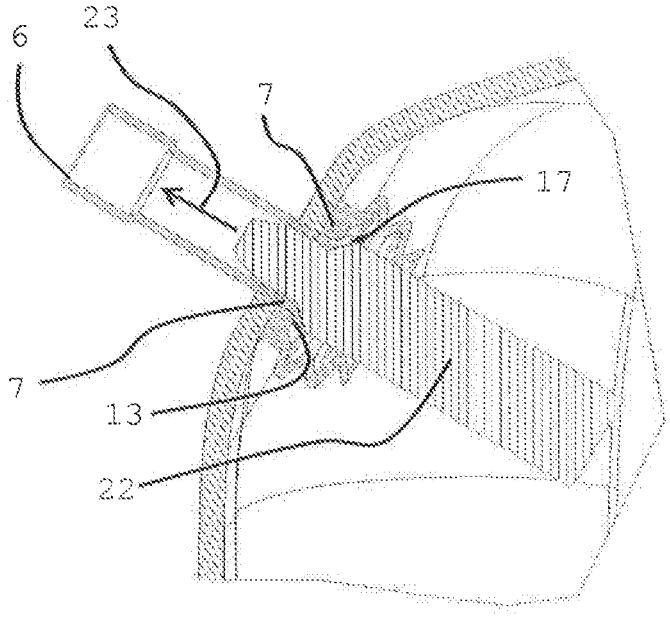
FIG. 5*b* shows a second method step for producing an end segment of a suction connection piece according to the invention

FIGS. 5*a* and 5*b* illustrate the method according to the invention for attaching the flexible connection element 10 to the end segment 7 and the inner wall 11 of the housing 1.

According to the invention, it is thereby first provided that the flexible connection element 10, with the first attachment segment 12 thereof, is pulled over the end segment 7 of the suction connection piece 6.

In order to bring the flexible connection element 10, in particular the first attachment segment 12 thereof, into a position that is beneficial for the attachment to the housing 1, it can possibly be provided that the flexible connection element 10 is slid forward in the direction of the housing 1 until the first end 20 of the first attachment segment 12 bears, at least in individual sections or, in the exemplary embodiment shown for the flexible connection element 10, even across the entire surface, against the inner wall 11 of the housing 1 and thus directly connects to said housing 1. Whether a sliding-forward of this type is necessary depends in particular on the length of the end segment 7.

After the positioning of the flexible connection element 10 on the end segment 7, a mandrel 22 is inserted into the end segment 7 via the outlet opening 17. This mandrel 22 comprises in any case a longitudinal segment that has a diameter which increases in an axial direction.

According to the invention, it is provided that the mandrel 22 is driven, preferably by means of a hammer, along a driving direction 23 in the direction of the housing 1, so that as a result of the longitudinal segment of the mandrel 22 that increases in diameter, a continuous widening of the outer jacket surface 18 of the end segment 7 is produced. As a result of the enlargement segment 13 of the end segment 7 produced in such a manner, the flexible connection element 10 is attached in a fixed manner to the inner wall 11 of the housing 1 by means of a clamping of the first attachment segment 12.

LIST OF REFERENCE NUMERALS

1 Housing
2 Cylinder block
3 Cylinder cover
4 Valve plate
5 Drive unit
6 Suction connection piece
7 End segment of the suction connection piece
8 Suction sound damper
9 Suction opening of the suction sound damper
10 Flexible connection element
11 Inner wall of the housing
12 First attachment segment
13 Enlargement segment
14 Retaining element (annulus)
15 Second attachment segment
16 Spacer segment
17 Outlet opening of the end segment
18 Outer jacket surface of the enlargement segment
19 End of the enlargement segment that faces the suction sound damper
20 First end of the first attachment segment
21 Second end of the first attachment segment
22 Mandrel
23 Driving direction

The invention claimed is:

1. An encapsulated refrigerant compressor comprising:

a drive unit, a cylinder block which comprises at least one cylinder and a piston in operative connection with the drive unit, that moves back and forth within the cylinder, a cylinder cover connected to the cylinder block via a valve plate, the valve plate comprising at least one inlet valve and at least one outlet valve in order to enable a flow, caused by movement of the piston, of refrigerant into the cylinder via the inlet valve and out of the cylinder via the outlet valve, a housing which encloses at least the drive unit, the cylinder block, and the cylinder cover, an end segment of a suction connection piece for the refrigerant protrudes into the housing and has an outlet opening via which refrigerant can flow into the interior of the housing, a suction sound damper comprising at least one suction opening facing the end segment, and a flexible connection element which produces a flow connection between the end segment and the suction opening of the suction sound damper to enable a transfer flow of refrigerant from the suction connection piece into the at least one suction sound damper via the end segment, wherein the end segment is structured to attach the flexible connection element to at least one of the end segment or an inner wall of the housing, and is embodied in the form of a pipe having an enlargement segment in which an outer jacket surface of the pipe widens so that an outermost part of the outlet opening is flared outwardly in a direction pointing towards the suction sound damper, wherein the flexible connection element comprises a first attachment segment that surrounds the end segment and is arranged between an end of the enlargement segment facing the suction sound damper and the inner wall of the housing, and wherein the first attachment segment has a first end that bears against the inner wall of the housing and a second end that bears against the enlargement segment.

2. The encapsulated refrigerant compressor according to claim 1, the enlargement segment comprises the outlet opening.

3. The encapsulated refrigerant compressor according to claim 1, wherein the widening of the outer jacket surface of the enlargement segment is produced by a bending-open or crimping.

4. The encapsulated refrigerant compressor according to claim 3, wherein the bending-open or crimping produces a continuous widening of the outer jacket of the enlargement segment.

5. The encapsulated refrigerant compressor according to claim 1, wherein the first attachment segment is clamped by the inner wall of the housing and the enlargement segment.

6. The encapsulated refrigerant compressor according to claim 1, wherein the flexible connection element is embodied as a bellows.

7. The encapsulated refrigerant compressor according to claim 1, wherein the flexible connection element comprises a second attachment segment that is fastened to the suction sound damper in a region of the suction opening.

8. The encapsulated refrigerant compressor according to claim 1, wherein the outer jacket of the enlargement segment widens continuously.

* * * * *